US005988545A

United States Patent [19]

King

[11] Patent Number: 5,988,545

[45] Date of Patent: Nov. 23, 1999

[54] METHOD FOR STORING AND DISPENSING CORED WIRE

[75] Inventor: Phillip Ronald King, Winsted, Conn.

[73] Assignee: Minerals Technologies, Inc., Bethlehem, Pa.

[21] Appl. No.: 09/000,989

[22] Filed: Dec. 30, 1997

[51] Int. Cl.[6] ..... B65H 55/04; B65H 54/00

[52] U.S. Cl. ..... 242/178; 242/470

[58] Field of Search ..... 242/176, 178, 242/169, 483.3, 602.1, 602.3, 159

[56] References Cited

U.S. PATENT DOCUMENTS

| | | | |
|---|---|---|---|
| 2,639,097 | 5/1953 | Scott, Jr. | 242/159 X |
| 3,876,167 | 4/1975 | Nittschalk et al. | 242/483.3 |
| 4,035,892 | 7/1977 | Ototani et al. . | |
| 4,094,666 | 6/1978 | Ototani . | |
| 4,097,268 | 6/1978 | Ototani et al. . | |
| 4,481,032 | 11/1984 | Kaiser . | |
| 4,512,800 | 4/1985 | Wirth, Jr. . | |
| 4,629,145 | 12/1986 | Graham | 242/483.3 |
| 4,671,820 | 6/1987 | Ototani et al. . | |
| 4,698,095 | 10/1987 | Ototani et al. . | |
| 4,705,261 | 11/1987 | Wirth, Jr. . | |
| 4,746,080 | 5/1988 | Pinson | 242/176 X |
| 4,925,125 | 5/1990 | LeCompte | 242/159 X |
| 5,067,665 | 11/1991 | LoStracco et al. | 242/176 X |
| 5,193,761 | 3/1993 | Fritz et al. | 242/176 X |

FOREIGN PATENT DOCUMENTS

| | | | |
|---|---|---|---|
| 717 497 | 1/1932 | France | 242/176 |

*Primary Examiner*—Michael R. Mansen
*Attorney, Agent, or Firm*—Ratner & Prestia

[57] ABSTRACT

Cored wire is spirally wound on a storage reel with fixed space between each spiral in a given layer. Alternate layers are wound across the preceding layer in the same manner until the reel is full.

5 Claims, 1 Drawing Sheet

METHOD FOR STORING AND DISPENSING CORED WIRE

BACKGROUND OF THE INVENTION

The present invention pertains to storing elongated cored wire on a spool and in particular a method for winding the cored wire onto the spool.

Cored wires, in particular a calcium core surrounded by a steel sheath, has found wide application in the melting of ferrous metals. The cored wire is used to introduce calcium into the molten ferrous metal after being tapped from a furnace, in order to reduce unwanted elements such as sulfur and oxygen in the molten bath. A detailed discussion of the overall process is contained in U.S. Pat. No. 4,481,032 the specification of which is incorporated in herein by reference.

In U.S. Pat. No. 4,512,800 there is a discussion of the method of using cored wire and an illustration of the method for storing the cored wire on a reel or spool which is prepared by the manufacturer of the cored wire and then transported to the users location. In conventional practice the cored wire is level wound on the storage reel.

U.S. Pat. No. 4,705,261 discloses a device for injecting the wire into the molten bath as the cored wire is removed or payed off of the storage and transport spool (reel).

One of the problems associated with using a level wound cored wire configuration is that the wire must be carefully wound onto the reel. Another problem results in the fact that with the level winding configuration the cored wire is difficult to remove from the storage reel.

SUMMARY OF THE INVENTION

According to the present invention it has been discovered that if the cored wire is spirally wound onto the reel with a defined space between each turn of the spiral to lay down a first layer and then each succeeding layer is spirally wound over the preceding layer in a similar configuration with a spaced spiral, that not only is the cored wire easier to wind onto the reel, but it is much easier for the user to remove (dispense) the wire from the reel.

In particular winding a cored wire having a nominal diameter of 5 mm (0.192 inches) or 8 mm (0.32 inches) results in a reel or spool that is easier to wind (takes less effort), can be wound faster than in a level wound configuration and is much easier for the user to remove the wire from the reel for use in the treatment of molten metals as discussed above.

Therefore, in one aspect the present invention is a method of storing and dispensing elongated cored wire on a spool by the steps of spirally winding a first layer of the cored wire on the spool with a measured space between each turn of the spiral, spirally winding a second layer of the wire over the first layer with a measured space between each turn of the spiral, the spirals of the second layer, lying across the spirals in the first layer, and thereafter continuously winding the cored wire in spaced spirals across previously wound layers until the spool is full.

The method of the present invention has particular applicability to the storage and dispensing of a calcium cored wire having a steel jacket and nominal diameters of 5 mm (0.192 inches) and 8 mm (0.32 inches). For the 8 millimeter wire a preferred configuration is to wind the wire using a 5 inch per revolution pitch, i.e. 5 inch lateral spacing between the successive spirals of the wire.

DETAILED DESCRIPTION OF THE INVENTION

Figure 1:
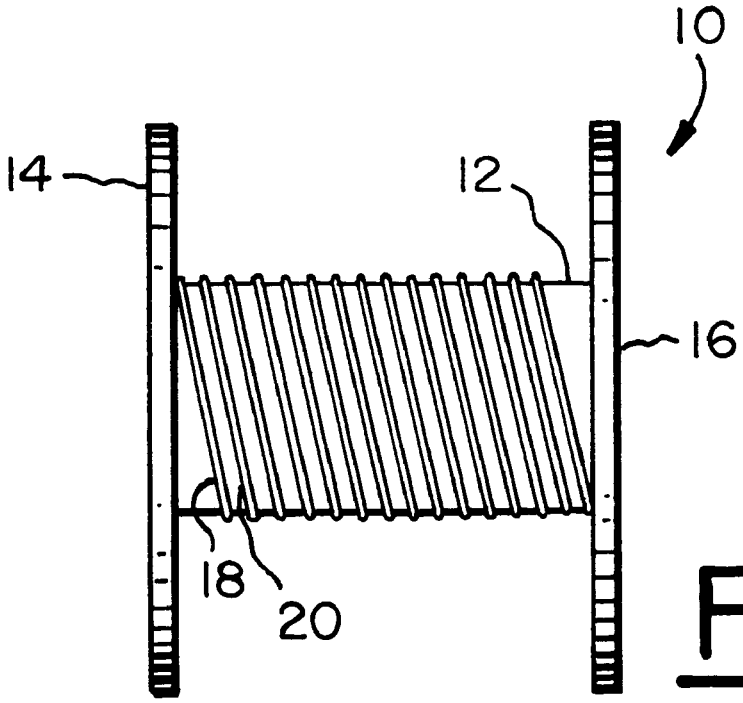
FIG. 1, is a schematic representation of a reel illustrating the winding of the first layer of cored wire according to the invention.

Referring to FIG. 1, there is shown a reel 10 having a center winding drum 12 and side faces 14, 16. These reels are well known in the art and have been used for many years for storing and dispensing wires such as cored wires used for treating molten ferrous metals by a process such as described in the aforementioned U.S. Pat. No. 4,481,032.

In accord with the present invention, in order to store and dispense a calcium cored wire, such as used in the process of the '032 patent, the wire is wound around the drum portion 12 of the reel 10 in a spiral fashion, such as shown in FIG. 1. Each spiral, e.g. 18, 20, is spaced laterally apart from its neighbor in an open pattern such as shown. In a preferred embodiment of the invention the first wrap is made on a 5 inch (126.9 mm) per revolution pitch when storing a cored wire having a nominal diameter of 8 mm (0.32 inches). The winding in a configuration wherein a 5 inch per revolution pitch is used results in a spacing of approximately 5 inches (126.9 mm) between each spiral in the first wrap.

Figure 2:
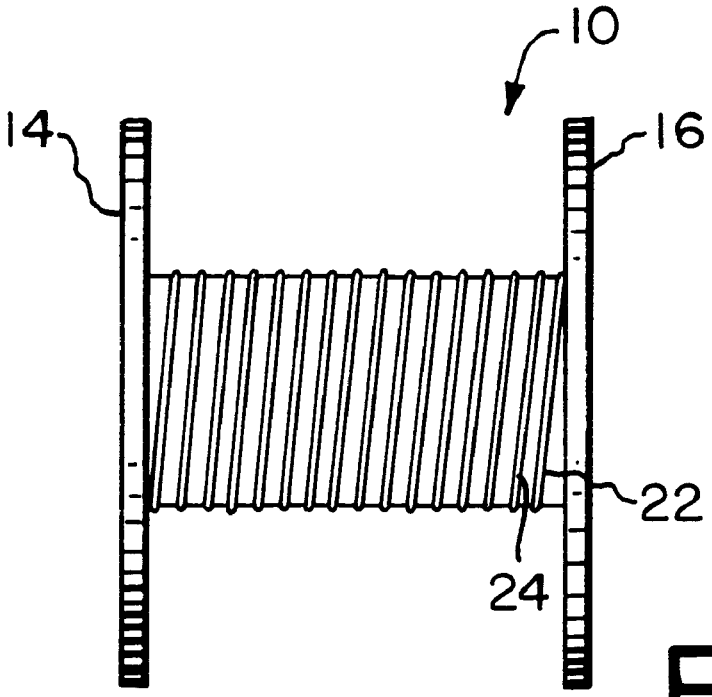
FIG. 2, is a schematic representation of a reel showing the second layer of wire wrapped according to the present invention.

Referring to FIG. 2, where the first layer is omitted for purposes of clarity only, the second layer containing spirals, e.g. 22, 24 is wound across the first layer in a reverse direction using a preferred 5 inch (126.9 mm) per revolution pitch, for the calcium cored wire having a nominal diameter of 8 mm (0.32 inches).

After the first and second wraps are made on the reel each, succeeding wrap is wound using the same 5 inch (126.9 mm) revolution per pitch and alternating the layers so they cross one another until the reel is completely full of wire. Thereafter, the end of the wire is fixed to one of the sides 14, 16 and the reel can be covered and delivered to a user.

Winding the clad wire onto the reel in the manner described above results in reducing the amount of effort or the work required to put the wire onto the reel so that the reels can be wound at a greater rate. More importantly the benefit to the user is that the wire can be payed off the reel with less tendency to bind or kink the wire.

The present invention results in reels that contain approximately 20% less wire than if the wire were placed on a reel in a level wind fashion, however, the benefits of easier and faster wrapping and easier payoff far out weigh the penalty in the reduced amount of product stored on a given reel.

The present invention is applicable to reels of varying sizes that are currently used in the storage and dispensing of clad wires.

Having thus illustrated and described my invention herein with reference to certain specific embodiments, the present invention is nevertheless not intended to be limited to the details shown. Furthermore, various modifications may be made in the details, within the scope of the invention that is defined by the appended claims.

What is claimed is:

1. A method of storing and dispensing elongated cored wire on a spool comprising the steps of:

spirally winding a first layer of said cord wire on said spool using a five inch (126.9 mm) per revolution pitch resulting in a measured space between each turn of said spiral;

spirally winding a second layer of said wire over said first layer using a five inch (126.9 mm) per revolution pitch resulting in a measured space between each turn of said spiral, said spirals of said second layer lying across said spirals of said first layer; and continuously winding said cored wire in spaced spirals across previously wound layers until said spool is full, whereby said spool can be wound more rapidly with said cored wire and said cored wire can be removed more rapidly than when said cored wire is level wound onto said spool.

2. A method according to claim 1 including winding a cored wire having a nominal diameter of 8 mm (0.32 inches).

3. A method according to claim 2 wherein said wire comprises a calcium core in a steel sheath.

4. A method according to claim 1 including the steps of preparing said reel after completion of winding said wire for shipment to a user.

5. A method according to claim 1 including winding a cored wire having a nominal diameter of 5 mm (0.197 inches).

* * * * *